United States Patent [19]

Alm

[11] Patent Number: 4,765,219

[45] Date of Patent: Aug. 23, 1988

[54] MAGNETIC PICK-UP FOR STRINGED MUSICAL INSTRUMENT

[76] Inventor: John A. Alm, P.O. Box 224, Tujunga, Calif. 91042-0224

[21] Appl. No.: 897,117

[22] Filed: Aug. 15, 1986

[51] Int. Cl.[4] ..... G10G 5/00; G10H 3/18

[52] U.S. Cl. ..... 84/1.15; 84/1.16; 84/327; 84/280; 224/910; 335/297

[58] Field of Search ..... 84/1.04, 1.14, 1.15, 84/1.16, 327, 278, 280; 336/119, 120, 130, 131, 234; 335/297; 224/910

[56] References Cited

U.S. PATENT DOCUMENTS

| | | | |
|---|---|---|---|
| 75,950 | 3/1868 | Mollenhauer . | |
| 491,372 | 2/1893 | Naberti | 84/280 |
| 492,884 | 3/1893 | Boyer . | |
| 925,481 | 6/1909 | Johns . | |
| 950,873 | 3/1910 | Smith . | |
| 1,199,685 | 9/1916 | Gaylord . | |
| 1,315,015 | 9/1919 | Doyle | 84/278 |
| 1,337,459 | 4/1920 | Lappalainen . | |
| 1,427,851 | 9/1922 | Rigg . | |
| 1,689,136 | 10/1928 | Hastings . | |
| 1,861,717 | 6/1932 | Pfeil . | |
| 1,895,749 | 1/1933 | Bishop . | |
| 2,048,515 | 7/1936 | Pfeil | 84/1 |
| 2,061,464 | 11/1936 | Heimers | 84/280 |
| 2,130,174 | 9/1938 | Beauchamp | 84/1 |
| 2,222,057 | 11/1940 | Benioff | 84/1.16 |
| 2,310,199 | 2/1943 | Beauchamp | 84/1.15 |
| 2,486,264 | 10/1949 | De Armond | 84/1.15 |
| 2,539,297 | 1/1951 | De Lazaro | 84/1.16 |
| 2,576,018 | 11/1951 | Johnson | 84/280 |
| 2,902,895 | 9/1959 | Sokolik | 84/280 |
| 2,978,945 | 4/1961 | Dopera et al. | 84/1.15 |
| 3,136,197 | 6/1964 | Bried | 84/280 |
| 3,571,483 | 3/1971 | Davidson | 84/1.16 |
| 3,822,628 | 7/1974 | Quemore, Sr. | 84/275 |
| 4,182,213 | 1/1980 | Iodice | 84/1.15 |
| 4,235,143 | 11/1980 | Hoexter | 84/1.16 |
| 4,348,930 | 9/1982 | Chobanian et al. | 84/1.15 |
| 4,442,749 | 4/1984 | DiMarzio et al. | 84/1.15 |

OTHER PUBLICATIONS

*Guitar Electronics for Musicians,* Donald Brosnac, copyright 1973, Wise Publications.

*Primary Examiner*—S. J. Witkowski

*Attorney, Agent, or Firm*—Delbert J. Barnard

[57] ABSTRACT

A magnetic pick-up is positioned below the strings of a stringed musical instrument having four strings. The pick-up comprises a long and narrow pick-up coil comprising wraps of insulated wire about a magnetic core. A pole piece is physically and magnetically connected to one end of the magnetic core. The pole piece includes a wide first portion which presents pole regions laterally inwardly adjacent the two outside strings of the instrument. It includes a narrower second portion which projects upwardly from the first portion and presents pole regions laterally inwardly adjacent the two inside strings. The coil and the pole piece produce a magnetic field which is elongated laterally of the instrument, generally parallel to the direction of greatest string displacement when the strings are stroked, finger or pick. The strings are located in the magnetic field.

26 Claims, 6 Drawing Sheets

Fig. 5
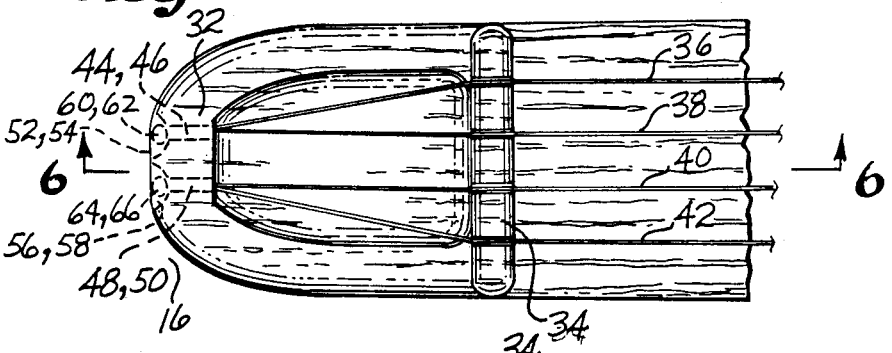
Fig. 6
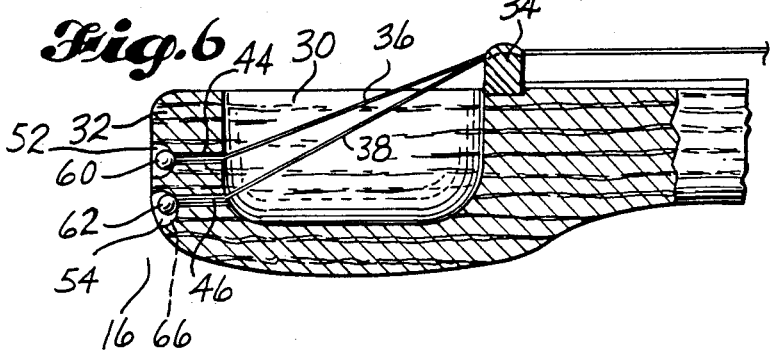
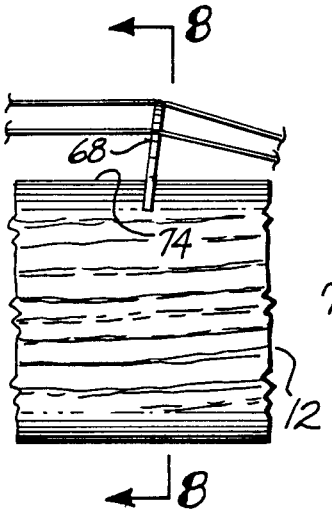
Fig. 7
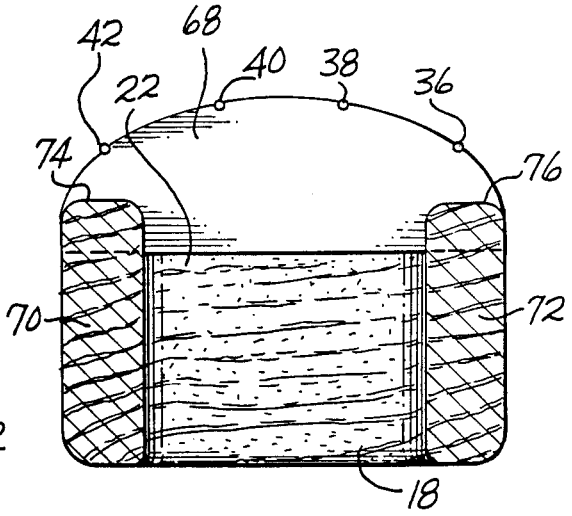
Fig. 8

Fig.14
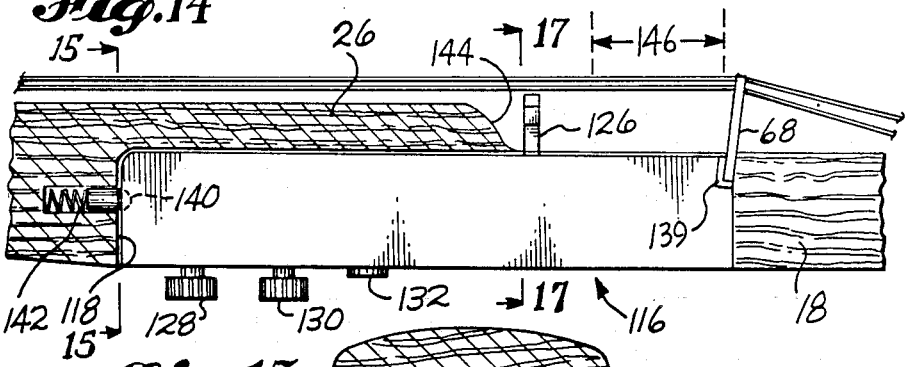
Fig.15
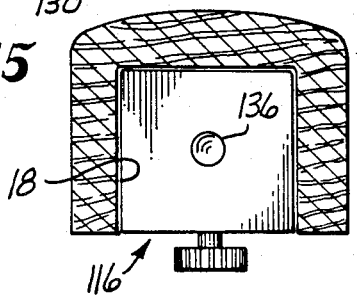
Fig.16
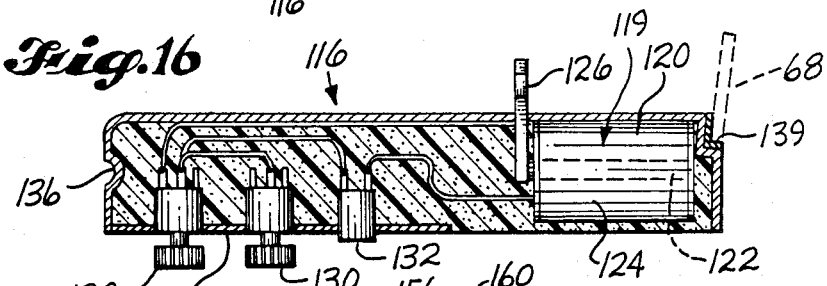
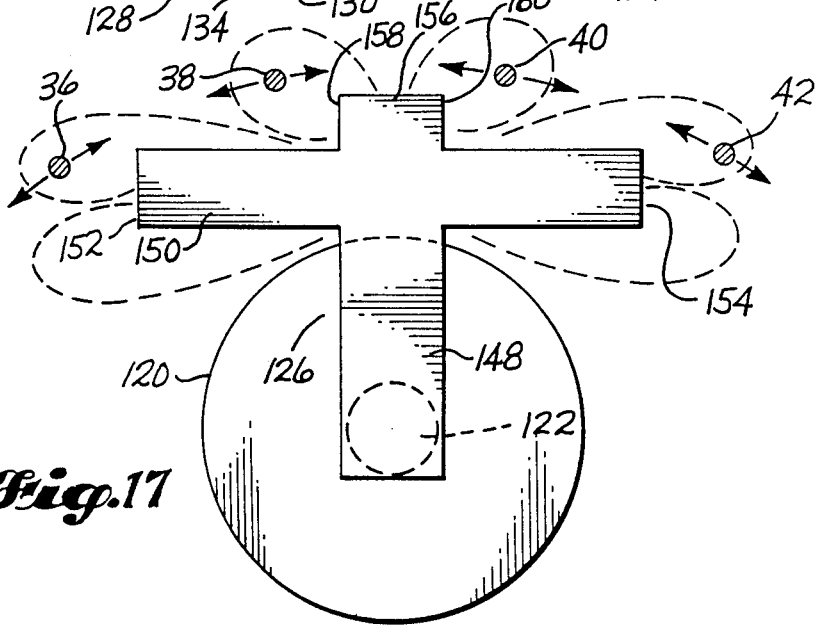
Fig.17

MAGNETIC PICK-UP FOR STRINGED MUSICAL INSTRUMENT

TECHNICAL FIELD

This invention relates to an electrical stringed musical instrument. More particularly, it relates to the provision of such an instrument which includes an improved magnetic pick-up system and an improved means of supporting and controlling the instrument, and which possesses improved structural characteristics.

BACKGROUND ART

Classical stringed instruments comprise a plurality of strings which extend over an acoustical chamber. The movement of a bow laterally across the strings causes the strings to vibrate and as they vibrate they cooperate with the acoustical chamber to produce music.

It is old to provide a conventional violin with a microphone that is attached to a wall of the acoustical chamber, for picking up the vibrations of such wall. An example of this type of electric stringed musical instrument is disclosed by U.S. Pat. No. 2,486,264, granted Oct. 25, 1949 to Harry De Armond.

It is also known to place a magnetic pick-up assembly underneath the bridge of a generally conventional violin for picking up the vibrations of such bridge. An example of this type of electric stringed musical instrument is disclosed by U.S. Pat. No. 2,978,945, granted Apr. 11, 1961 to Rudolph Dopera and Edward. E. Dopera.

It is also known to substitute a magnetic or crystal pick-up for the acoustical chamber, enabling a reconstruction of the violin into a long, narrow "stick" configuration. Examples of instruments of this type are disclosed by the following U.S. Pat. Nos.: 1,861,717, granted June 7, 1932 to Victor A. Pfeil; No. 2,048,515, granted July 21, 1936 to Victor A. Pfeil; No. 2,130,174, granted Sept. 13, 1938 to George D. Beauchamp; No. 2,222,057, granted Nov. 19, 1940 to Hugo Benioff; No. 2,310,199, granted Feb. 9, 1943 to George D. Beauchamp; No. 2,539,297, granted Jan. 23, 1951 to Luis N. G. De Lazaro; No. 4,182,213, granted Jan. 8, 1980 to Robert M. Iodice; No. 4,235,143, granted Nov. 25, 1980 to Robert S. Hoexter; No. 4,348,930, granted Sept. 14, 1982, to Dennis A. Chobanian and R. Allan McNaughton; and No. 4,442,749, granted Apr. 17, 1984 to Lawrence P. DiMarzio and Steven L. Blucher.

The instruments disclosed by these patents either present a pick-up which is characterized by a magnetic pole or poles positioned above and below, or only below, each string and adapted to produce a flux field which is elongated in a direction perpendicular to the direction of predominant movement of the strings when moved by finger, pick or a bow. It is a principal object of the invention to provide a "stick" type violin instrument which has improved structural characteristics when compared with the known "stick" violins, and which includes an improved magnetic pick-up.

It is known to provide a conventional violin with some sort of attachment which functions to engage the musician's chin, neck, collar bone region, torso or clothing collar, for providing support for the end of the instrument that is closest to the musician. Examples of these supports are shown by the following U.S. Pat. No. 491,372, granted Feb. 7, 1893 to Giorgio Narberti; No. 492,884, granted Mar. 7, 1893 to James F. Boyer; No. 925,481, granted June 22, 1909, to Frank R. Johns; No. 950,873, granted Mar. 1, 1910 to Henry Allen Smith; No. 1,199,685, granted Sept. 26, 1916 to Norton R. Gaylord; No. 1,337,459, granted Apr. 20, 1920 to Alfred Lappalainen; No. 1,895,749, granted Jan. 31, 1933 to Peter Stevens Bishop; No. 2,061,464, granted Nov. 17, 1936 to Rudolf Heimers; No. 2,576,018, granted Nov. 20, 1951 to Marcus E. Johnson; No. 2,902,895, granted Sept. 8, 1959 to Edward Sokolik; No. 3,136,197, granted June 9, 1964 to Julien A. Bried; and No. 3,822,628, granted July 9, 1974 to William J. Quemore, Sr.

It is another object of the present invention to provide an improved type of neck collar support for a "stick" type violin.

U.S. Pat. No. 3,571,483, granted Mar. 16, 1971 to Peter Davidson, relates to a magnetic pick-up for a guitar. This patent should be considered, together with all of the other above listed patents, when putting the present invention into proper perspective relative to the prior art. Also of interest is a publication entitled Guitar Electronics for Musicians, by Donald Brosnac, published by Wise Publications in 1983, and available in the United States from Amsco Publication, New York.

DISCLOSURE OF THE INVENTION

The magnetic pick-up of the present invention is basically characterized by a pole piece which presents pole regions laterally inwardly adjacent the strings of the instrument, positioned to produce a magnetic field which is elongated laterally of the instrument, generally parallel to the direction of predominant string displacement when the strings are stroked by a bow, finger or pick.

In accordance with an aspect of the invention, the pole piece is connected to an end of a core magnet which is long and narrow. Insulated wire is wrapped around the core magnet to form a pick-up coil. The fact that the core magnet is long and small in diameter permits it to be wrapped with a large number of turns while keeping the diameter of the coil to a minimum. The closer the coil wraps are to the core magnet, the greater the pick-up sensitivity of the pick-up unit. A long, small diameter magnetic core results in a coil having a maximum number of turns produced by a minimum length of wire. This results in maximum amps being produced from the coil with a minimum resistance to current flow. The beneficial result is a maximum pick-up output. There is a strong parallel between resistance and inductance in any pick-up that uses a magnetic load in a coil. A high inductance level in a pick-up will impede its ability to produce high frequencies. The relatively low DC resistance/inductance level of the pick-up of this invention allows excellent high frequency response. Conventional short fat pick-up coils are often wound with many wraps for a higher output. Since the circumference of these short fat coils is relatively long, the higher output is typically offset by higher resistance/inductance. This causes high frequency loss. The outer wraps on these short fat coils are often too far from the magnet's field of flux. This results in poor pick-up sensitivity.

The preferred form of magnetic pick-up is usable with a four-string stringed instrument of a type which is played by use of a bow or plucked by a finger or pick. It comprises a pole piece having a relatively wide first portion which presents pole regions laterally inwardly adjacent the two outside strings, and a narrower second portion which projects upwardly from the first portion and presents pole regions laterally inwardly adjacent the two inside strings. The pole piece and the magnet to which it is attached produces a magnetic field which is elongated laterally of the instrument, generally parallel to the direction of predominate string displacement when the strings are stroked by a bow, finger or pick. The strings are in the magnetic field.

In preferred form, the instrument has a one-piece body. The body is elongated and has a chin end, a hand end, a top and a bottom. An elongated cavity is formed in the bottom. A window is formed in the top. The window opens into the cavity. Sidewalls outwardly bound the cavity. An elongated finger board portion extends from the cavity outwardly to and includes the hand end of the body. The strings of the instrument extend longitudinally of the body. At the hand end of the body the strings are anchored to an end wall. The opposite ends of the strings are connected to rotatable portions of tension keys. The tensioning keys are mounted on the sidewalls of the body near the chin end of the instrument. A first bridge extends laterally of the instrument, across the window on the top of the instrument. A second bridge is positioned endwise inwardly of the anchored ends of the strings. The strings extend from the end wall where they are anchored to and over the second bridge, and from the second bridge to and over the first bridge, and from the first bridge through the window to locations of connection to the rotating string receiving portions of the tensioning keys. This construction of the body, and the particular mounting location of the tensioning keys, results in an instrument which is quite simple in construction, is easy to manufacture, involves a minimum of material, but yet is quite strong.

In accordance with an important aspect of the invention, the pick-up unit is incorporated within a cartridge which is easily slipped into and moved out from the body cavity. This permits instant substitution of cartridges, for purposes of replacement or repair, or for changing tone.

A further aspect of the invention is to provide a neck collar support which distributes the weight of the instrument over a large surface area, and which gives the musician good control over the position of the instrument by his body movement.

Other more detailed features of the invention will hereinafter be described as a part of the description of the best mode of the invention.

BRIEF DESCRIPTION OF THE DRAWINGS

Like reference numerals are used to designate like parts throughout the several views of the drawings, and:

FIG. 5 is a fragmentary top plan view of the hand end of the violin;

FIG. 6 is a sectional view taken substantially along line 6—6 of FIG. 5;

FIG. 7 is a fragmentary side elevational view of a midportion of the violin, showing a bridge in end elevation;

FIG. 8 is a sectional view taken substantially along line 8—8 of FIG. 7;

FIG. 14 is a view like FIG. 13, but showing the magnetic pick-up cartridge positioned in the bottom cavity;

FIG. 15 is a cross-sectional view taken substantially along line 15—15 of FIG. 14;

FIG. 16 is a view of the internal parts of the pick-up cartridge, shown within the envelope of the cartridge;

FIG. 17 is a sectional view taken substantially along line 17—17 of FIG. 14, omitting the resin body of the pick-up cartridge and omitting the body of the violin;

FIG. 18 is a view like FIG. 17, but showing the axis of the coil extending perpendicular to the strings;

BEST MODE FOR CARRYING OUT THE INVENTION

The illustrated instrument 10 is a violin. However, it is to be understood that the invention can be used with other stringed instruments as well.

Referring to FIGS. 1–4, the instrument 10 comprises an elongated "stick" type body 12 having a chin end 14 and a hand end 16. The chin end 14 is so named because in use it is adjacent the chin of the musician. The hand end 16 is so named because in use it is the end closest to the hand of the musician.

Figure 3:
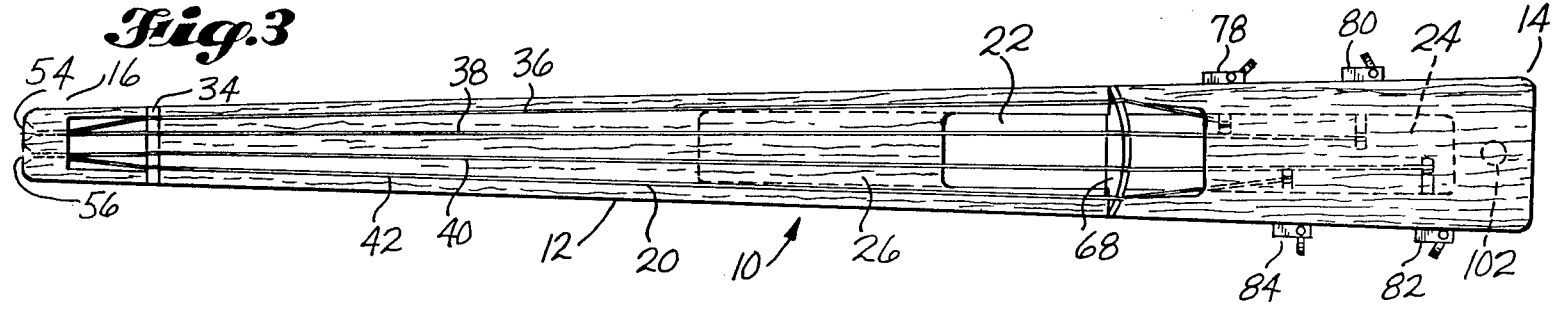
FIG. 3 is a top plan view of the violin.

In preferred form, the body 12 is a one-piece construction. It may be carved from a piece of wood or cast from a suitable plastic or other castable material. Body 12 includes an elongated body cavity 18 (FIG. 4), a top 20 and an elongated window 22 in the top 20 (FIG. 3). Window 22 is substantially shorter than the cavity 18. A first portion 24 of the top projects over the end of the cavity 18 that is closest to the chin end 14. A second portion 26 of the top projects over the opposite end of the cavity 18.

Figure 2:
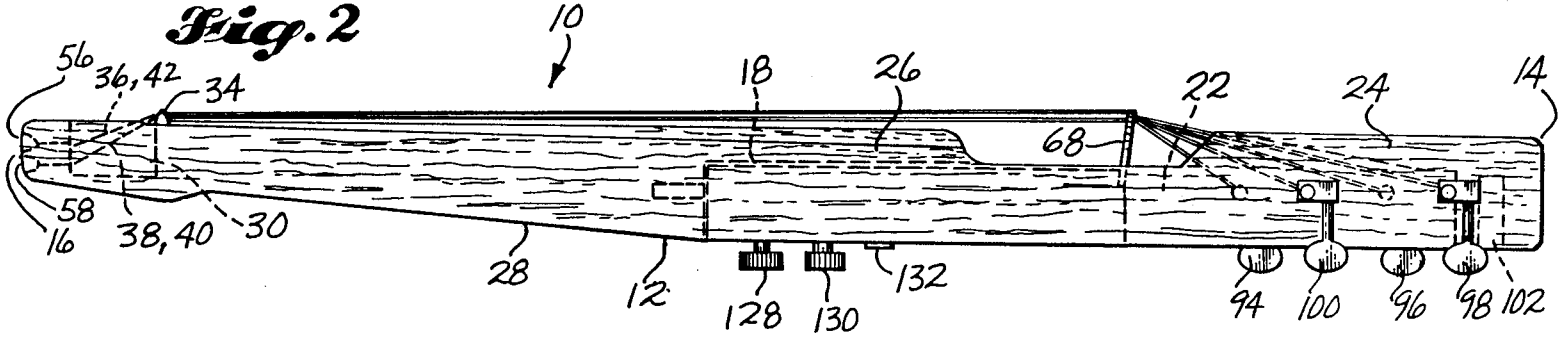
FIG. 2 is a side elevational view of the violin.
Figure 4:
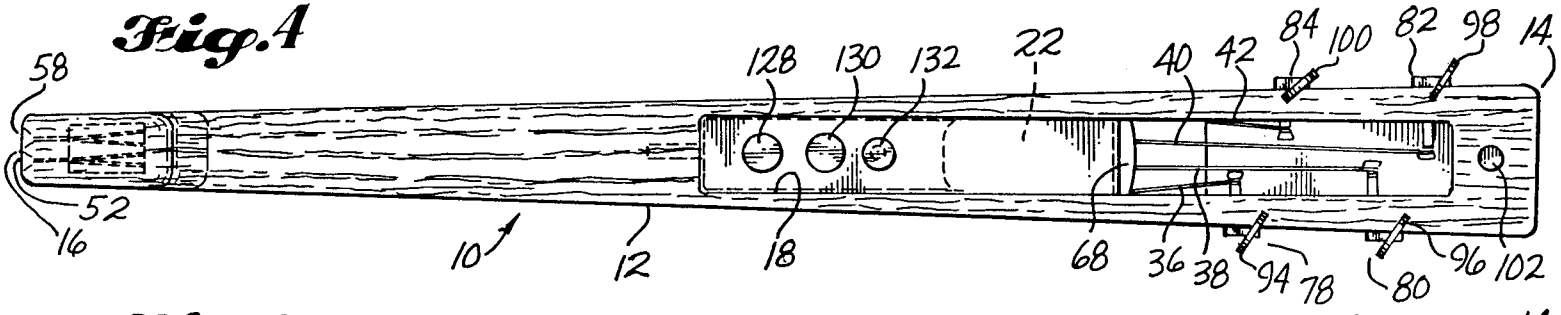
FIG. 4 is a bottom plan view of the violin.

Referring to FIGS. 3 and 4 which are top and bottom plan views of the instrument 10, the instrument 10 narrows as it extends from its chin end 14 to its hand end 16. Referring to FIG. 2, the instrument 10 may have a substantially constant depth extending from its chin end 14 through the region of the cavity 18. Then, the bottom 28 may rise or slope upwardly as it extends out to the hand end 16. The upwardly sloping bottom 28 includes a step 17 situated inwardly adjacent the hand end 16.

At the hand end 16 of the instrument 10, the body 12 includes a cavity 30 positioned between an end wall 32 and a bridge 34 (FIGS. 5 and 6). The instrument 10 includes a set of four strings 36, 38, 40, 42. Strings 36, 42 are hereinafter sometimes referred to as the outside strings. Strings 38, 40 are sometimes hereinafter referred to as the inside strings. Four holes 44, 46, 48, 50 are provided in the end wall 32, one for each string 36, 38, 40, 42. Each hole 44, 46, 48, 50 extends substantially perpendicular to the end wall 32, as shown in FIG. 6. The holes 44, 46 for strings 36, 38 are situated one above the other. In similar fashion, the holes 48, 50 for the strings 40, 42 are situated one above the other. The end wall 32 is formed to include recesses or countersinks 52, 54, 56, 58 at the outer end of the holes 44, 46, 48, 50. The strings 36, 38, 40, 42 have enlarged end portions 60, 62, 64, 66 which are received in the recesses 52, 54, 56, 58. These enlarged end portions 60, 62, 64, 66 are too large to pass through the holes 44, 46, 48, 50. Thus, when tension is applied to the strings 36, 38, 40, 42, the enlarged end portions 60, 62, 64, 66 serve to anchor the ends of the strings 36, 38, 40, 42 in position relative to the end wall 32.

A bridge 68 extends across the instrument 10, in the region of the window 22, as shown in FIGS. 7 and 8. The body 12 has side portions 70, 72 which outwardly bound the sides of the cavity 18. Upper edge portions of the sidewalls 70, 72 are slotted at 74, 76 and the base portion of the bridge 68 is received within the notches 74, 76.

Figure 9:
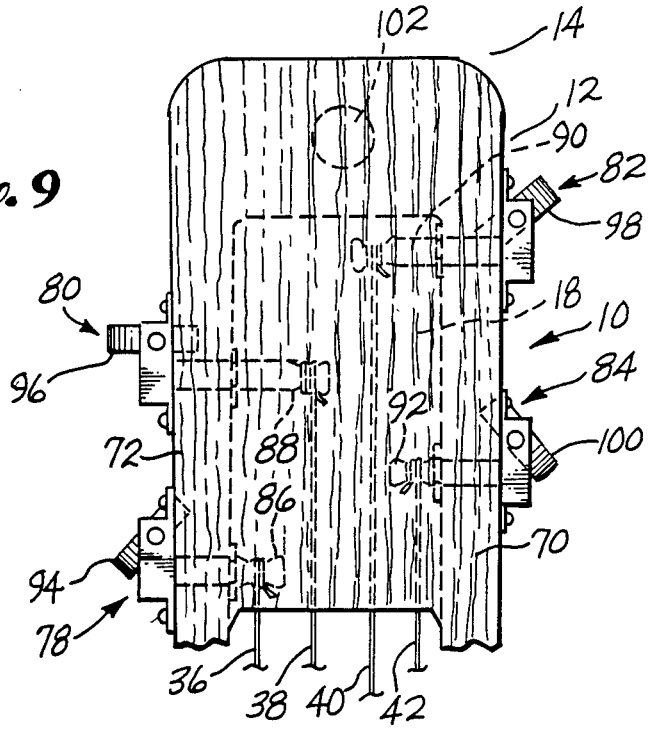
FIG. 9 is a top plan view taken at the chin end of the violin.

A set of tensioning keys 78, 80, 82, 84 are provided at the chin end 14, as shown in FIG. 9. These keys 78, 80, 82, 84 include string end receiving portions 86, 88, 90, 92 which are situated within the cavity 18. These string end receiving portions 86, 88, 90, 92 are mounted in the sidewalls 70, 72. The ends of the strings 36, 38, 40, 42 are secured to the string end receiving portions 86, 88, 90, 92 in known fashion. The string end receiving portions 86, 88, 90, 92 are rotatable in position, for wrapping the strings 36, 38, 40, 42 on them, to in that manner put the strings 36, 38, 40, 42 in tension. Preferably, the string end receiving portions 86, 88, 90, 92 are rotated by means of key handles 94, 96, 98, 100 which are positioned outwardly of the sidewalls 70, 72 and are connected to the portions 86, 88, 90, 92 by worm gear and spur gears. This type of tensioning key is conventionally used with modern guitars.

The bridge 68 is hereinafter sometimes referred to as the first bridge. The bridge 34 is hereinafter sometimes referred to as the second bridge.

As best shown by FIG. 2, the strings 36, 38, 40, 42 extend from the anchoring means to and over the bridge 34, and from the bridge 34 to and over the bridge 68, and from the bridge 68 down through the window 22 to locations of connection to the string receiving portions 86, 88, 90, 92 of the tensioning keys 78, 80, 82, 84.

The sidewalls 70, 72 have substantial depth and thus can adequately carry the loads applied to them when the strings 36, 38, 40, 42 are put into tension. The presence of the top portion 24 at the chin end 14, the substantially solid region endwise outwardly of the cavity 18 at the chin end 14, the top portion 26, and the solid construction of the finger board portion all contribute to the body 12 having good structural characteristics which prevent it from twisting in response to the tension loads imposed on it by the strings 36, 38, 40, 42.

Preferably, the bridge receiving slots 74, 76 are angled so that they lean toward the chin end 14, as shown in FIG. 7. The angle x may be about eight-six degrees, for example. This leaning of the bridge 68 somewhat evens the angle on the opposite sides of the bridge 68, between it and the strings 36, 38, 40, 42. If the bridge 68 were to be made perpendicular to the top, then the angle between it and the strings 36, 38, 40, 42 on the hand-end side of the bridge 68 would be about ninety degrees. The angle between the bridge 68 and the strings 36, 38, 40, 42 on the chin end side of the bridge 68 would be an acute angle. When the strings 36, 38, 40, 42 are tensioned, they move easier relative to the bridge 68. The substantial balancing of the angles on the opposite side of the bridge 68 reduces both string wear and bridge wear.

Preferably, the upper surface portion of the top 20 extending from the window 22 to the bridge 34 constitutes the finger board of the instrument 10. A separate finger board member is not needed.

Figure 10:
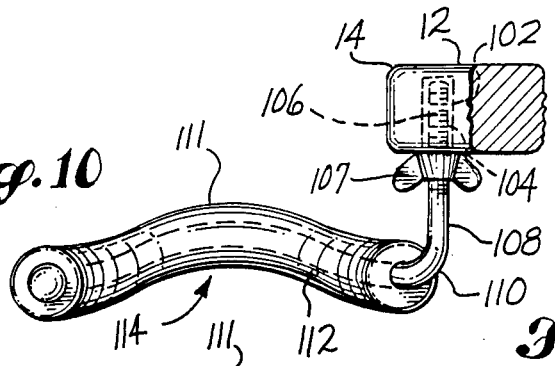
FIG. 10 is an elevational view of the neck collar, looking towards the opening end to the collar, showing only a fragmentary portion of the violin.
Figure 11:
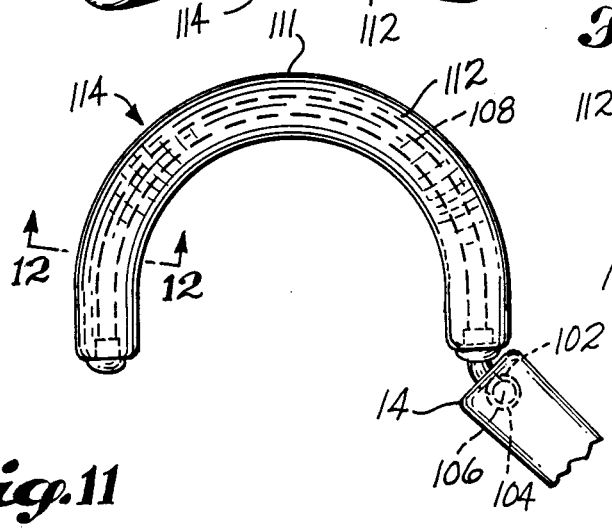
FIG. 11 is a top plan view of the neck collar.
Figure 12:
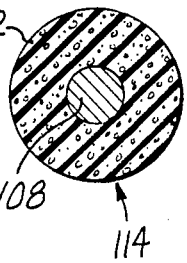
FIG. 12 is a sectional view taken substantially along line 12—12 of FIG. 11.

The end portion of the body 12 situated endwise outwardly from the cavity 18 at the chin end 14 is preferably solid except for the inclusion of a socket, 102 into which an internally threaded member 104 is fitted. This member 104 receives the externally threaded end portion 106 of a metal neck yoke frame 108. The position of the externally threaded end portion 106 in relation to the internally threaded member 104 is secured by means of a second internally threaded member, shown in the form of a wingnut 107 in FIG. 10. The positioning of the internally threaded members 104 and 107 in relation to the externally threaded end portion 106 determines the position of the instrument body 12 relative to the neck and shoulders of the musician. The neck yoke frame 108 extends first axially from the threaded portion and then makes a substantially right angle bend 110 and then is bent into a U-shape, as shown in FIG. 11. The U-shaped portion of the neck yoke frame 108 includes an upwardly rising arch 111 (FIGS. 10 and 11). The upwardly rising arch 111 rests against the back of the musicians upper neck to provide better means of controlling the neck yoke frame's support of the instrument body 12. The U-shape portion is covered by a tubular jacket 112 constructed from a suitable foam plastic. This jacket 112 includes a central opening in which the U-shaped portion of the frame 108 is positioned, as shown in FIG. 12. An attractive end piece may be provided at each end of the jacket.

Figure 1:
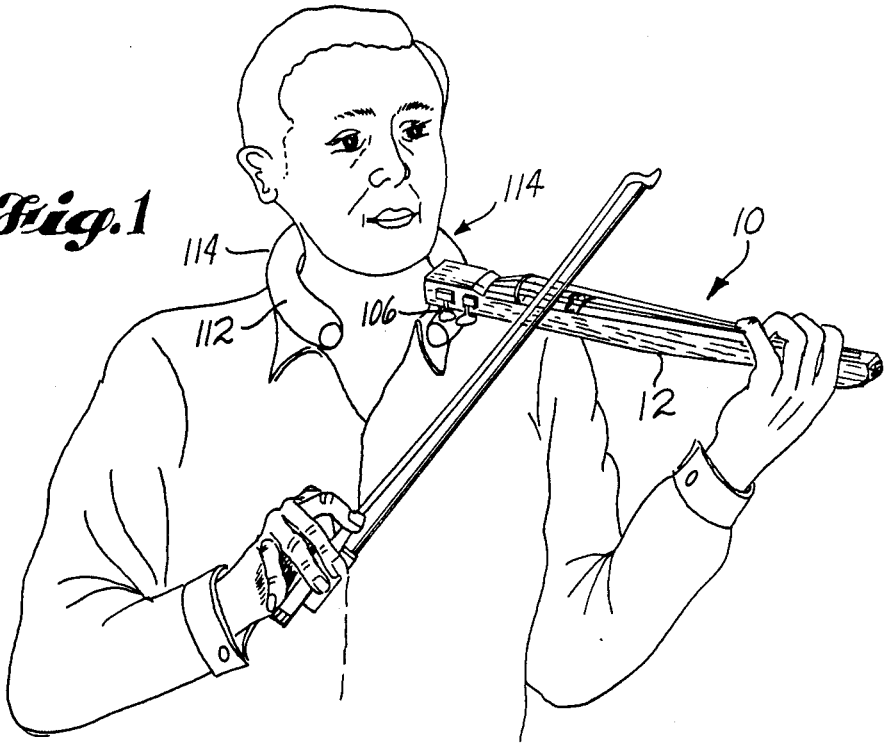
FIG. 1 is a pictorial fragmentary view of a musician playing a violin constructed in accordance with the present invention.

As shown by FIG. 1, the neck piece 114 fits like a collar around the neck of the musician. The jacket 112 serves both as padding to make the collar comfortable and helps position the neck piece 114 relative to the musician's neck and shoulders. It is relatively large and distributes the instrument weight over a large surface area. Preferably, the neck piece 114 fits snugly enough about the neck of the musician that the musician can remove his hand from the instrument 10 and it will extend in cantilever fashion out from his neck. It is then possible to control the position of the instrument by upper body movement. The neck piece 114 can be easily bent by hand for adjusting the curvature of the metal frame, to in that manner change the fit of the collar to the neck of the musician. As shown by FIG. 1, when the neck piece 114 is in place, the support post portion 106 extends substantially vertically upwardly and the instrument 10 extends substantially horizontally outwardly from its connection to the support post 106.

In accordance with an aspect of the invention, the instrument 10 includes a magnetic pick-up 119 incorporated in a cartridge 116 which plugs into a cavity 18.

Referring to FIGS. 13–16, the magnetic pick-up cartridge 116 is sized to fit within the portion of the bottom cavity 18 which extends between the bridge 68 and an end wall 118. This portion of the cavity 18 and the cartridge 116 are both rectangular in shape.

Referring to FIG. 16, the cartridge 116 comprises a coil 120 which includes a magnetic core 122 and insulated wire 124 wrapped around the core 122. A pole piece 126 is physically and magnetically connected to one end of the core 122. This may easily be done by putting the pole piece 126 into tight surface-to-surface contact with the end of the core 122, and then applying an epoxy glue around the end of the core 122, between it and the pole piece 126.

Magnetic pick-up cartridge 116 further comprises a volume control 128, a tone control 130 and a jack receptacle 132. Preferably, the casings of these elements 128, 130, 132 are negative leads and are all connected to a ground plate 134.

In preferred form, the coil 120, the lower portion of the pole piece 126, and the portions of the elements 128, 130, 132 which are above the ground plate 134, are all encased in a resin matrix. The resin matrix provides the body of the cartridge 116. The volume control 128 and the tone control 130 include rotatable control knobs which are positioned on the underneath side of the ground plate 134. The socket entrance into the jack receptacle 132 opens downwardly through the ground plate 134.

In preferred form, a recess 136 is provided in one end of the resin body. A notch 138 is formed in the opposite end. A spring loaded detent 140 is mounted in the end wall 118 of the bottom recess 18. This detent 140 is backed by a spring 142. The spring 142 is shown somewhat schematically in the form of a coil spring. A folded leaf or other suitable spring may be substituted for the spring-loaded detent.

Figure 13:
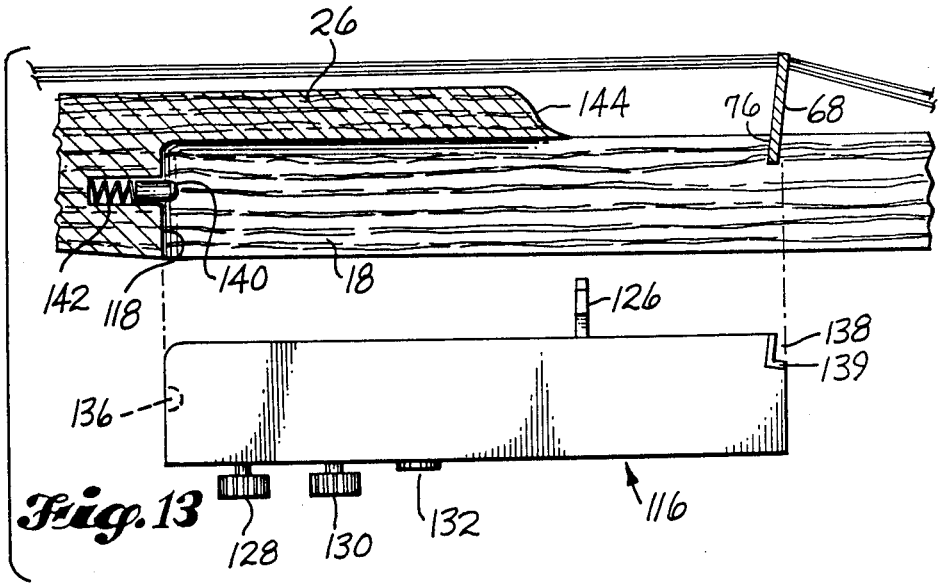
FIG. 13 is a fragmentary side elevational view of a midportion of the violin, with a portion of the body of the violin in section, and with the magnetic pick-up cartridge shown in a spaced relationship to the bottom cavity in the body of the violin.

Referring to FIGS. 13 and 14, the cartridge 116 is moved toward the cavity 18, with the recess 136 aimed toward the detent 140. The detent 140 is placed into the recess 136 and the cartridge is slid endwise toward the wall 118 and moved upwardly until the lower portion of the bridge 68 is received within the notch 138. The notch is lined with a vibration isolating material 139. The spring force, the engagement of the detent 140 in the recess 136, and the engagement between the notch 138 and the lower portion of bridge 68 will serve to hold the cartridge 116 within the bottom recess 18.

As shown by FIG. 14, when the cartridge 116 is within the bottom recess 18 the upper exposed portion of the pole piece 126 is positioned close to the end 144 of top part 26. This position of the pole piece 126 relative to the bridge 68 places it within what may be referred to as the "sweet" zone of the vibrating strings, i.e. where quality tones exist. The bow hairs are usually moved across the violin strings within the zone 146 (FIG. 14), closely adjacent the bridge 68. The bow hairs frictionally grip the violin strings momentarily, causing them to move sideways in response to the bow movement. It has been found that a placement of the pole piece 126 away from the bridge 68, adjacent the end 144 (FIG. 13) of the finger board, results in the production of music with better tonal quality or timbre than would be obtained if the pole piece 126 were to be positioned closer to the bridge 68.

In preferred form, the pole piece 126 is in the form of a cross. It includes a stem 148, the lower end of which is secured to an end of the core 122. The exposed region of the pole piece 126 includes a wide first portion 150, which is also the cross arm of the cross. Pole piece portion 150 presents pole regions 152, 154 which are laterally inwardly adjacent the two outside strings 36, 42. The exposed portion of the pole piece 26 includes a narrower second portion 156 which is an upward extension of the stem 148. It extends upwardly from the central portion of the cross arm 150 and presents pole regions 158, 160 laterally inwardly adjacent the two inside strings 38, 40.

The pole regions 152, 154, 158, 160 may be positioned slightly below the plane of movement of the strings 36, 38, 40, 42. They may be positioned substantially at the plane. Or, they may be positioned such that they project upwardly through the plane. In the latter situation, and even in the second situation, there might be some contact between the bow hairs and the pole piece 126. Such contact would only happen when the bow pairs are moved across the strings outside of the generally accepted bowing zone 146 adjacent the bridge 68.

The construction of the pole piece 126 results in flux regions being generated which have substantial components extending generally parallel to the direction of predominant movement of the strings 36, 38, 40, 42 when the instrument is being played.

Figure 18:
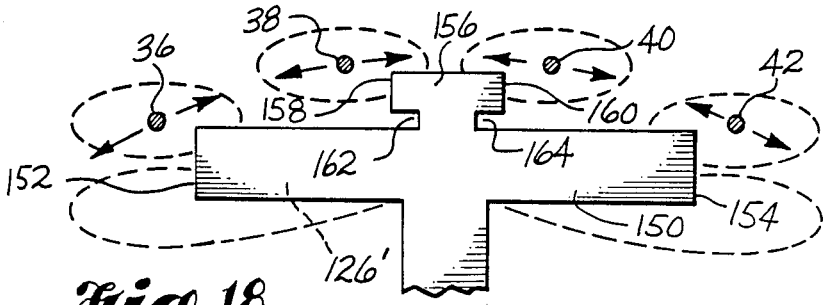
FIG. 18 is a view like FIG. 17, but of only the upper portion of the pole piece, showing a modification in the construction of the pole piece.

Referring to FIG. 18, it has been found that the horizontal intensity of the flux field generated by the center portion 156 of the pole piece 126' can be enhanced by the formation of recesses 162, 164 on each side of portion 156, where portion 156 connects to the cross arm 150. It was found that the flux field produced by a pole piece 126' including the recesses 162, 164 had a stronger horizontal component in the region of the strings 38, 40. An attempt has been made to show this in FIG. 18 by picturing the flux fields surrounding strings 38, 40 wider in the horizontal direction, in comparison to the way then appear in FIG. 17.

Figure 19:
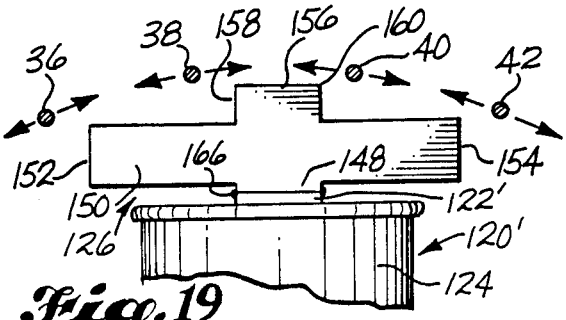
Figure 20:
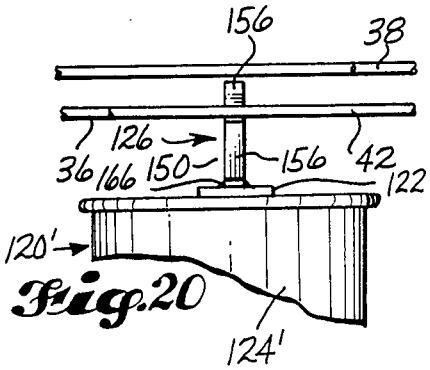
FIG. 20 is a side elevational view of the structure shown by FIG. 19.

The magnetic pick-up 119 may utilize a single coil or a plurality of coils on the same core. The coil(s) can be quite large and may be constructed to be relatively long and narrow. The coil that is long and narrow is preferred over a coil that has the same length of wire on it but which is shorter and wider. It is preferred that the axis of the coil extend parallel to the strings 36, 38, 40, 42. If this is done, the coil can be incorporated entirely into a cartridge 116 that can be constructed to place the coil entirely within the bottom cavity 18 of the instrument 10. However, the performance of the coil does not depend on this orientation. The same coil could be oriented with its axis perpendicular to the strings 36, 38, 40, 42. This arrangement is shown by FIGS. 19 and 20. This orientation of the coil could result in a portion of the magnetic pick-up cartridge extending out from the bottom cavity 18, generally perpendicular to the instrument body 12. Referring to FIGS. 19 and 20, the construction of pole piece 126 has not changed and its orientation relative to the strings 36, 38, 40, 42 is the same. For this reason, the flux field is not repeated in FIG. 19.

In the embodiment of FIGS. 19 and 20, the lower end of the stem 148 is brought into surface-to-surface contact with the end surface of the magnetic core 122'. Epoxy glue, or the like, is used in the regions 166, to physically connect the stem 148 to the end of the core 122'. The surface-to-surface contact of these members provides the magnetic connection.

Figure 21:
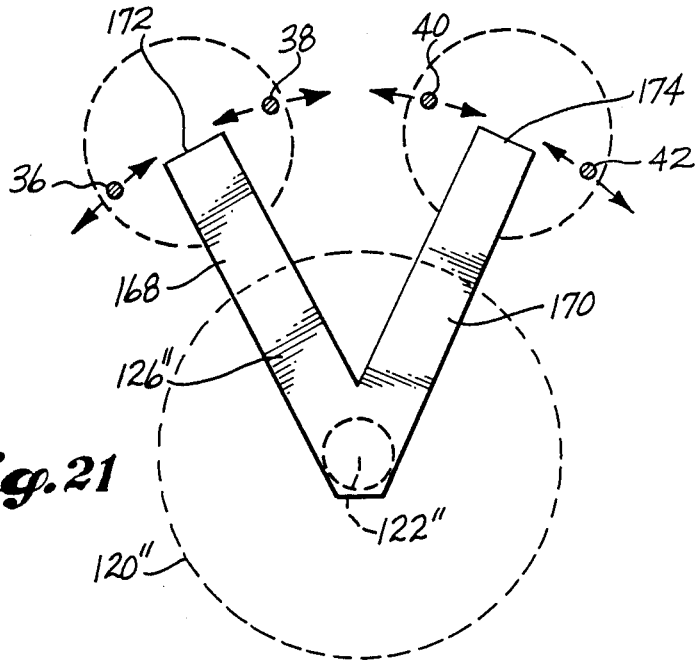
FIG. 21 is a view like FIG. 17, but of a third embodiment of the pole piece.

FIG. 21 shows another modified form of the pole piece 126''. As before, this pole piece 126'' includes a lower end which is both physically and magnetically connected to an end of the core 122'' of a coil 120''. In this embodiment, the pole piece 126'' includes a pair of arms 168, 170 which extend upwardly from an apex, to form a V. The upper end of arm 168 presents a pole region 172 which is positioned substantially laterally between the strings 36, 38. The upper end of arm 170 presents a pole region 174 which is in a like manner positioned substantially laterally between the strings 40, 42. As before, the exact placement of the ends of these pole regions can vary somewhat, dependent upon whether it is desirable to avoid all possible contact between the bow hairs and the pole regions 172, 174.

Stick-type electronic violins have certain known advantages over acoustical violins. The musicians can play with equal facility in any key or finger position because there is no awkward body to reach around. The "stick" body of the instrument is very comfortable to hold.

The present invention provides an easy to install and easy to remove cartridge or insert. This enables the musician to quickly remove one cartridge and replace it with another, in seconds, for the purpose of varying the sound produced by the instrument, or for repairing any electrical, magnetic, or mechanical problem in a cartridge.

In accordance with an aspect of the invention, the electronic parts are embedded in a resin matrix. This protects them against all types of wear and tear.

The body of the instrument is quite strong. It is affected very little by temperature and humidity changes. Any body vibration caused by handling is substantially acoustically isolated from the strings by massive brass bridges. The tuning keys are located at the chin end of the body. This allows easier tuning. The one-piece design of the instrument body can easily be cast or machined out of almost any material in a minimum of man hours. The neck support completely supports the instrument to allow maximum mobility without the body of the instrument irritating the vioinist's chin or neck. This total instrument support also frees the musician's string-fingering hand from having to support the instrument and thus allows much quicker and easier string-fingering movements. The tubular jacket of this neckrest distributes the instrument's weight over a large surface area to require relatively low pounds per square inch to be supported by the musician's neck and shoulders. The neck collar securely positions the instrument away from the musician's face, allowing the musician to sing freely while playing the instrument.

The pole piece of the instrument is shaped to focus the fields of flux so that they will be better agitated parallel to the plane of greatest string vibration. On most string instruments this is a side-to-side string vibration. The core magnet of the coil is long and thin. The longer and thinner the core magnet is, the more wraps of output it can have before the outside wraps are positioned too far from the field of flux. The closer the coil wraps are to the magnet, the greater the sensitivity of the pick-up unit.

In accordance with an aspect of the invention, the core magnet 122, 122', 122" is wound with a magnetic wire coil. The selection of a relatively long, small diameter coil allows a maximum number of wraps with a minimum length of wire. This allows maximum amps to be produced from the coil with a minimum resistance to current flow. This results in maximum pick-up output. There is a strong parallel between resistant and inductance in any magnetic pick-up that uses an iron load in a coil. A high inductance level in a magnetic pick-up will impede the ability of the magnetic pick-up to produce high frequencies. The relatively low DC resistance/inductance per output level of the pick-up of the present invention allows excellent high frequency response. Conventional short fat pick-up coils are often wound with many wraps for higher output. This requires a greater length of wire per wrap, since the circumference of the short fat coils is relatively long. The higher output of such short fat coils is typically offset by higher resistance/inductance. This causes high frequency loss. The outer wraps on the short fat coils are often too far from the magnet's field of flux. This results, in poor pick-up sensitivity. The use of a long, thin, coil provide good pick-up sensitivity.

In preferred form, the coil is constructed in the following manner. A permanent magnet core is selected which is small in diameter and which is long. Spool end pieces are slid over the ends of the magnet to form with the magnet a spool on which a coil or coils may be wound. The core magnet is coated with a thin layer of liquid plastic, in the region between the end pieces, to insulate it from the coil(s). Insulated wire is then wrapped around the insulated core magnet, to form the coil(s). Preferably, the coil or coils are saturated with beeswax, a resin or other suitable material to eliminate microphonics. The cartridge may be provided with a wide variety of electronics. Preferably, the assembled interior components of the cartridge are completely coated with an insulating material such as liquid plastic. This assembly may then be coated with a shielding material such as liquid nickel. The shielding is preferably connected to ground at the outer edge of the in/out jack casing (FIG. 16). This preferred method of shielding completely encloses all components of the cartridge electrical circuitry to provide the most effective shielding possible.

It is to be appreciated that the system described above could be altered somewhat without departing from the spirit and scope of the invention. In accordance with established patent law, the system that has been illustrated and described is not to be used for defining the invention to be protected. Rather, the limits of protection are specified by the appended claims. These claims are to be interpreted in accordance with established rules of claim interpretation, including use of the doctrine of equivalents.

What is claimed is:

1. An electric stringed musical instrument, comprising:

a set of four laterally spaced apart strings in tension, including two inside strings and two outside strings; and a magnetic pick-up comprising a magnetic core positioned below the strings, wire windings extending about said core, and a magnetic pole piece connected to said core and extending toward said strings, said magnetic pole piece including a wide first portion which presents pole regions between the inside and outside strings, each laterally inwardly adjacent a said outside string, and a narrower second portion which projects upwardly from a center part of said first portion and presents pole regions between the two inside strings, each laterally inwardly adjacent a said inside string, wherein the pole piece produces magnetic flux regions which are elongated generally laterally of the instrument, and wherein the strings are in said magnetic flux regions.

2. An electric stringed musical instrument according to claim 1, wherein said core extends substantially parallel to the strings, said pole piece is physically and magnetically connected to one end of the core, and said pole piece is a flat piece of magnetic material located within a plane which extends laterally of the instrument.

3. An electric stringed musical instrument according to claim 2, wherein the pole piece is in the form of a cross and it includes a vertical stem, the lower end of which is connected to the end of the core, and a cross arm having end surfaces, said cross arm constituting the wide first portion of the pole piece and said end surfaces constituting the pole regions which are positioned between the two outside strings, and said stem having an upper portion which projects upwardly above the cross arm, said upper portion of the stem constituting the narrower second portion of the pole piece and having top and side surfaces which constitute the pole regions which are positioned between the two inside strings, laterally inwardly adjacent the inside strings.

4. An electric stringed musical instrument according to claim 3, wherein the upper portion of said stem is recessed on each of its sides adjacent where it connects to the cross arm, so that the upper portion of the stem includes a narrow neck whereat it is attached to the cross arm and a wider head upwardly of the neck.

5. An electric stringed musical instrument according to claim 1, wherein said core extends substantially perpendicular to the strings, said pole piece is physically and magnetically connected to one end of the core, and said magnetic pole piece is a flat piece of magnetic material located within a plane which extends laterally of the instrument.

6. An electric stringed musical instrument according to claim 5, wherein the pole piece is in the form of a cross and it includes a vertical stem, the lower end of which is connected to the end of the core, and a cross arm having end surfaces, said cross arm constituting the wide first portion of the pole piece and said end surfaces constituting the pole regions which are positioned between the inside and outside strings, laterally inwardly adjacent the two outside strings, and said stem having an upper portion which projects upwardly above the cross arm, said upper portion of the stem constituting the narrower second portion of the pole piece and having top and side surfaces which constitute the pole regions which are positioned between the two inside strings, laterally inwardly adjacent the inside strings.

7. An electric stringed musical instrument according to claim 6, wherein the upper portion of said stem is recessed on each of its sides adjacent where it connects to the cross arm, so that the upper portion of the stem includes a narrow neck whereat it is attached to the cross arm and a wider head outwardly of the neck.

8. An electric stringed musical instrument, comprising:

an elongated body having a chin end, a hand end, a top and a bottom, said body including an elongated bottom cavity, a window in said top which opens into said cavity, sidewalls outwardly bounding said cavity, and an elongated finger board portion extending from said cavity outwardly to, and including, said hand end of said body;

a set of at least four laterally spaced apart strings extending lengthwise of said body along and above said finger board;

key means mounted on the sidewalls of the cavity near the chin end of the instrument, said key means including string end receiving portions within said cavity and means for rotating said string end receiving portions, for tensioning the strings;

a first bridge means extending laterally of the instrument, across the window in the top of the instrument, said first bridge means being supported at its ends by the sidewalls of the cavity;

anchoring means at the hand end of the instrument for anchoring end portions of said strings;

second bridge means endwise inwardly of said anchoring means, wherein said strings extend from said anchoring means to and over the second bridge, and from the second bridge to and over the first bridge, and from the first bridge through said window to locations of connection to the string receiving portions of the tensioning keys; and magnetic pick-up means removably mounted within said cavity from the bottom of the instrument, and including a core and a pole piece projecting from said core up through said window into a position adjacent said strings, on the hand-end side of the first bridge means.

9. An electric stringed musical instrument according to claim 8, wherein said strings include two inside strings and two outside strings, and said magnetic pick-up means includes wire windings extending about said core, said pole piece is connected to said core and extends toward said strings, and said magnetic pole piece includes a wide first portion which presents pole regions between the inside and outside strings, each laterally inwardly adjacent a said outside string, and a narrower second portion which projects upwardly from said first portion and presents pole regions between the two inside strings, each laterally inwardly adjacent a said inside string, wherein the core, the wire windings and the pole piece produce magnetic flux regions which are elongated laterally of the instrument, and wherein the strings are in said magnetic flux regions.

10. An electric stringed musical instrument according to claim 9, wherein the core extends substantially parallel to the strings, said pole piece is physically and magnetically connected to one end of the core, and said pole piece is a flat piece of magnetic material located within a plane which extends laterally of the instrument.

11. An electric stringed musical instrument according to claim 10, wherein the pole piece is in the form of a cross and it includes a vertical stem, the lower end of which is connected to the end of the core, and a cross arm, said cross arm constituting the wide first portion of the pole piece, and said stem having an upper portion which projects upwardly above the cross arm, said upper portion of the stem constituting the narrower second portion of the pole piece.

12. An electric stringed musical instrument according to claim 11, wherein the upper portion of said stem is recessed on each of its sides adjacent where it connects to the cross arm, so that the upper portion of the stem includes a narrow neck whereat it attaches to the cross arm and a wider head outwardly of the neck.

13. An electric stringed musical instrument according to claim 9, wherein the core extends substantially perpendicular to the strings, said pole piece is physically and magnetically connected to one end of the core, and said pole piece is a flat piece of magnetic material located within a plane which extends laterally of the instrument.

14. An electric stringed musical instrument according to claim 13, wherein the pole piece is in the form of a cross and it includes a vertical stem, the lower end of which is connected to the end of the core, and a cross arm, said cross arm constituting the wide first portion of the pole piece, and said stem having an upper portion which projects upwardly above the cross arm, said upper portion of the stem constituting the narrower second portion of the pole piece.

15. An electrical stringed musical instrument according to claim 14, wherein the upper portion of said stem is recessed on each of its sides adjacent where it connects to the cross arm, so that the upper portion of the stem includes a narrow neck whereat it attaches to the cross arm and a wider head outwardly of the neck.

16. An electric stringed musical instrument according to claim 8, wherein said body is a one-piece construction.

17. An electric stringed musical instrument according to claim 16, wherein said window in the top is shorter than said bottom cavity, and the top includes a portion at each end of the cavity which extends over a portion of the cavity.

18. An electric stringed musical instrument according to claim 8, wherein the anchoring means comprises an end wall at the hand end of the instrument having openings through which the strings extend, said instrument includes a top cavity located between said end wall and said second bridge, and wherein said strings extend from said second bridge through said cavity and through said openings in the end wall, and wherein said strings include enlarged end portions which are larger in size than the openings in the end wall.

19. An electric stringed musical instrument according to claim 8, wherein said instrument includes means for securing said magnetic pickup-means in said cavity.

20. An electric stringed musical instrument according to claim 8, further comprising a neck collar support for the instrument, said neck collar support comprising a frame having a first portion generally bent in the shape of a U, and a second portion which extends upwardly at an angle from a side of the U-shaped first portion, to a point of connection with the instrument, at the chin end of the instrument, and a surrounding cover on the U-shaped first portion of the collar constructed from a soft cushioning material of a diameter to distribute the weight of the instrument over a large surface area of the user's neck.

21. An electric stringed musical instrument according to claim 20, wherein the bottom of the instrument at the chin end of the instrument includes a socket and the upstanding portion of the collar is received within said socket.

22. An electric string musical instrument according to claim 8, wherein the first bridge means is tilted towards the chin end of the elongated body an amount sufficient to make the angle between the strings and the first bridge means on the hand end of the elongated body to be substantially equal to the angle between the strings and the first bridge means on the chin end of the elongated body.

23. An electric string musical instrument according to claim 20, wherein the first portion of the neck collar includes an upwardly rising arch section positioned to rest against the back of the user's neck.

24. An electric string musical instrument according to claim 20, wherein said frame is bendable by hand for adjusting the curvature of the first portion of the neck collar, to in that manner change the fit of the collar to the neck of the user, and said surrounding cover has sufficient cross sectional dimension that when it is on the neck of the user, and adjusted to fit snugly against the neck, the user can remove his hand from the instrument and the instrument will be supported by the neck collar, in cantilever fashion out from the collar, and the position of the instrument can be controlled by upper body movement of the user.

25. An electric string instrument according to claim 24, wherein the first portion of the neck collar includes an upwardly rising arch section positioned to rest against the back of the user's neck, and functioning as a lever in contact with the neck, allowing the user to raise and lower the instrument by nodding his head forwardly and rearwardly.

26. An electric stringed musical instrument, comprising:

a plurality of laterally spaced apart strings in tension; and a magnetic pick-up comprising a magnetic core positioned below the strings and insulated wire windings extending about said core, and a magnetic pole piece connected to said magnetic core and extending from the magnetic core toward said strings, said magnetic pole piece presenting pole regions between and laterally adjacent said strings, oriented to produce laterally elongated magnetic flux regions, wherein the strings are in said magnetic flux regions;

wherein the magnetic pole piece comprises a pair of arms extending away from the magnetic core at an acute angle to each other, each of which has side portions which are positioned laterally adjacent the strings of the instrument; and wherein each arm has an end portion which is situated generally between two strings of the instrument, and which produces a flux region having a substantial component in the direction of string movement when the strings are stroked.

* * * * *